US007476191B2

(12) United States Patent
Putch et al.

(10) Patent No.: US 7,476,191 B2
(45) Date of Patent: Jan. 13, 2009

(54) DIE CUTTING/SCORING APPARATUS SHEET MATERIAL DRIVING MEMBER

(75) Inventors: Richard Putch, Wexford, PA (US); Kenneth Ray Neal, Magnolia, TX (US)

(73) Assignee: Dicar, Inc., Pine Brook, NJ (US)

( * ) Notice: Subject to any disclaimer, the term of this patent is extended or adjusted under 35 U.S.C. 154(b) by 0 days.

(21) Appl. No.: 11/534,025

(22) Filed: Sep. 21, 2006

(65) Prior Publication Data

US 2007/0082798 A1 Apr. 12, 2007

Related U.S. Application Data

(60) Provisional application No. 60/725,477, filed on Oct. 11, 2005.

(51) Int. Cl.
*B31B 49/00* (2006.01)

(52) U.S. Cl. ..... 493/144; 493/354; 493/369

(58) Field of Classification Search ..... 493/144, 493/147, 156, 287, 354, 363, 364, 365, 369, 493/469, 480; 83/331, 332, 333
See application file for complete search history.

(56) References Cited

U.S. PATENT DOCUMENTS 3,537,632 A * 11/1970 Watson ..... 226/191
3,541,656 A * 11/1970 Devon ..... 226/191
3,616,145 A * 10/1971 Clifton ..... 442/68
3,668,752 A * 6/1972 Clifton et al. ..... 492/8
3,775,821 A * 12/1973 Somerville ..... 198/722
3,824,927 A * 7/1974 Pugh et al. ..... 101/378
3,965,786 A 6/1976 D'Luhy
4,831,930 A 5/1989 Leanna
5,076,128 A * 12/1991 O'Connor et al. ..... 83/659
5,078,535 A * 1/1992 Kirkpatrick ..... 403/339
5,184,999 A * 2/1993 Vigano' ..... 493/435
5,379,671 A 1/1995 Kang
5,653,169 A 8/1997 Puschnerat et al.
5,916,346 A * 6/1999 Neal ..... 83/659
6,135,002 A * 10/2000 Neal ..... 83/659
6,575,065 B2 6/2003 Kapolnek (Continued)

FOREIGN PATENT DOCUMENTS

GB 2016373 9/1979

*Primary Examiner*—Paul R Durand
(74) *Attorney, Agent, or Firm*—Lowenstein Sandler PC

(57) ABSTRACT

A die cutting/scoring apparatus has die cutting/scoring and blanket covered steel anvil roller pairs arranged in sections some of which sections displace to permit dismounting of and changing die cutting/scoring rule members or printing members mounted on plywood substrates, which are bolted to a roller. The roller pairs also convey sheet material being processed through the sections. Sheet material pliable drive members are provided which replace the die cutting rule members or printing members on a roller in an idle section. The drive members comprise pliable magnetic substrates made of vinyl, rubber or elastomeric material which magnetically attach to a corresponding steel roller that is being idled. A pliable compressible foam or other rubber or plastic material high friction drive engagement member is bonded to the substrate forming a strip which is easily and quickly wrapped about a roller. The engagement member is provided with teeth to frictionally engage, and without damage, the sheet material being processed by the apparatus to convey the sheet material through the otherwise idle section.

20 Claims, 8 Drawing Sheets

U.S. PATENT DOCUMENTS 6,785,963 B2 * 9/2004 Kirkpatrick et al. ..... 29/895.3
2003/0138620 A1 7/2003 Fonseca
2005/0045005 A1 3/2005 Hamilton et al.

* cited by examiner

DIE CUTTING/SCORING APPARATUS SHEET MATERIAL DRIVING MEMBER

This application claims the benefit of provisional application Ser. No. 60/725,477 filed Oct. 11, 2005 and incorporated by reference herein in its entirety.

This invention relates to sheet material blank driving devices used in place of die cutting/scoring rules or printing devices attached to mating rollers in a sheet material die cutting/scoring apparatus.

Rotary die cutting/scoring apparatuses are widely used in the box forming and related industries to cut and/or score to form creases and/or perforate sheet material such as paperboard and the like. These apparatuses have two mating rotating cylinders, one of which carries a cutting knife and/or a scoring device for forming creases in sheet material or rule as otherwise known. The other cylinder forms an anvil covered with a plastic blanket against which the cutting knife or rule as it is known or scoring rule bear as the sheet material is cut and/or scored. The cutting and scoring may occur using the same or different rollers as desired. The cutting/scoring rules cut/score the sheet material into the desired configuration, the scoring forming creases, which are used to form hinges in the material to form the final product such as a paperboard box and the like. These machines also may have multiple sections each with two mating cylinders wherein one of the cylinders of each section performs either a printing or die cutting/scoring operation on the sheet material. In both the cutting/scoring operation and the printing operation, the two rotating mating cylinders also frictionally engage and convey the sheet material through the apparatus.

The cutting and scoring rules or printing cylinders and the mating blanket covered anvil rotate at the same speed while the sheet material is being cut or printed. The cutting and scoring rules or printing cylinder also grip and convey the sheet material through the rotating cylinders.

The mating cylinders either for cutting, scoring or printing are located in discrete sections of the apparatus. These sections are movable relative to each other to provide access to the cylinders for changing the cutting knives, the scoring rules or printing plates. The rules or printing portions are provided in relatively rigid semi cylindrical members or shells which are typically bolted to the mating cylinders, which have mating screw holes for the bolts. Typically there are 40-50 bolts used per member which generally overly about 180° or 270° of a cylinder. Each rule or printing portion member is attached with such bolts. These members may be plywood or urethane.

According to a particular job in which a series of blank sheet materials are processed through the apparatus, a cutting and/or scoring or printing cylinder may be idle and not used in one (or possibly more) of the sections of the apparatus. These sections in certain implementations, as noted, are movable relative to one another to allow access to the rule or printing cylinder to allow the replacement of a rule or printing member for a particular job being run.

The replacement of the rule or printing members is time consuming and results in idle time. At times there may be as many as ten or more jobs being run on an apparatus in a given day. In the case where a rule member or printing member is not used, the die cutting or scoring rule member or printing member needs to be removed from the corresponding cylinder. However, removing that member leaves a blank area in the section for driving the sheet material through that section. Presently, that member is replaced by a drive member for driving the sheet material through that section of the apparatus to perform the drive function of the removed rule or printing member. This requires two semi cylindrical relatively rigid drive members to be attached to the cylinder. Each such drive semi cylindrical member is generally also made of a relatively rigid substrate such as plywood. A drive engagement member for the sheet material being processed, such as a rubber or other high friction material in the form of spaced strips, are glued or otherwise attached to the plywood substrate of the drive member. Two semicylindrical drive members cooperate to encircle the rule or print roll cylinder such that the high friction material strips form a continuous drive band about the cylinder. These bands engage the sheet material being processed in that section to convey the sheet material through that section of the machine which is otherwise idle with respect to cutting, scoring or printing.

The removal of the rule members or printing members and their replacement with a drive member about a cylinder is time consuming as a large number of bolts need to be unscrewed and screwed. It is estimated that it takes about 20 minutes to mount and dismount the mating drive members to a cutting or printing cylinder. If as many as ten jobs are to be run in a day, that means as much as 200 minutes (3.3 hours) of machine down time are consumed in mounting and dismounting the drive members. This is not satisfactory for a die cutting and scoring apparatus that may cost upwardly of a million dollars or more.

U.S. Pat. No. 6,575,065 to Kapolnek discloses a rotary bridge assembly. A urethane base flexible bridge die is relatively stiff, but flexible, and has an inner surface and an outer surface. The bridge die is used on a discrete section of a rotary die cylinder and is used with at least on rotary cutting die mounted to a rotary cutting cylinder. A plurality of rubber strips are attached to the outer surface of the bridge die. The rotary cutting die is attached in discrete sections to mounting holes in the cylinder. When die plates are positioned on the die cylinder, there may be sections of the cylinder that do not have a die plate attached. This causes an unevenness between portions of the cylinder such that the material being cut may not be effectively driven through the rotary cutting machine and might bind, jam or lead to breakage of the rotary cutting die.

One solution is to provide multiple layers of rubber or Velcro stacked on top of each other to fill in areas where the die plates are not attached lo the cylinder. However, this solution is described as being unsatisfactory and may lead to jams or the layers of rubber may peel or break off from the cylinder. Also the adhering of Velcro or rubber layers is disclosed as unsatisfactory as being time consuming.

Another solution suggested is to fill the areas missing the die plates with a bridge which is rigid and made of epoxy base material mounted to the cylinder by screws passing through the bridge into receiving holes in the cylinder, It is disclosed that such bridges are also unsatisfactory as they may not precisely match the radius of the mating rotary die cutting cylinder.

The patent provides a solution in which a bridge assembly is provided that has scores so that the bridge assembly may be resized by removing a portion of the bridge assembly at a score. A plurality of rubber strips are provided on the outer surface of the bridge assembly. The bridge assembly may be attached to the rotary cylinder by magnetic means. The bridge die is disclosed as made of urethane to provide a low shrink factor to ensure that the bridge die shape is retained, i.e., the bridge die is relatively rigid although flexible.

The problem with the bridge die is that it entails the use of relatively large sections of costly urethane, which requires molding, to bridge the gap between currently used die sections on a given cylinder. This disclosure does not contemplate the problem noted above as to the use of multiple drive members in place of cutting die members when the cylinder is idle. That is, there is no suggestion that the bridge dies could be used to replace the currently used cutting die members that are time consuming to install, but only to bridge gaps in the cutting dies in use. Even if so used in place of cutting dies, the bridge dies contemplated encompass relatively large and costly molded urethane relatively rigid sections, which need be attached by bolts or screws, or even if magnetic, the sections are relatively large and stiff and thus may encounter difficulties in attachment to the mating cylinder which is time consuming. The patent discloses that the bridge dies may be flexed onto the cylinder, which may encounter difficulties and additional time for installation as well.

US Published Application No. US 2003/0138620 discloses a flexible magnetic layer based rubber mat of extensive area used to protect the roof or floor of a vehicle carrying luggage and the like. The mat has a flexible magnetic layer under a rubberized layer.

U.S. Pat. No. 3,668,752 discloses a coating roller where the roller is a magnetic cylinder and a plurality of magnetically attracted roller coverings supported on the outside of the cylinder. The roller is used to apply coatings to cans and the like.

U.S. Pat. No. 4,831,930 discloses a magnetic cylinder for holding etched magnetizable plates used in printing or die cutting presses.

U.S. Pat. No. 5,379,671 discloses a magnetic saddle for non-magnetic die-cutting cylinders. The saddle is used for mounting magnetic etched dies onto rotating cylinders and includes a segment of a cylinder wall on the outer surface of which is an array of permanent magnets and an arrangement for attaching the saddle to a die cutting cylinder.

U.S. Pat. No. 5,6453,169 discloses a rubber blanket cylinder for offset printing that uses a cylinder body that has magnetic strips to retain a rubber blanket packing comprised of a rubber blanket and a ferromagnetic rubber blanket support.

US Published Application No. US 2005/0045005 discloses a rotary cutting die which is mountable on a metal cylinder and includes a rotary die plate having a concave, inner surface which is magnetically attractable and is mounted on a concave, outer surface of the die plate. Connectors may be engaged with the cutting blade and the die plate. Magnetic engagement members are in the rotary die plate.

U.S. Pat. No. 3,965,786 discloses a rotary die cutter comprising a pair of plate and anvil cylinders rotatable about fixed and spaced axes for die cutting a web passing there between.

UK patent application No. 2 016 373 discloses rollers for printing machines such as offset printing having a magnetic cylinder base and a printing blanket having one or more layers with reinforcing members therein and one or more layers of rubber or rubber like. The underside of the printing blanket is adhesively connected to a thin flexible foil like ferromagnetic metal plate and the metal plate is retained radially to the cylinder base by magnetic force. Pins locate an end of the plate.

None of the above noted references relates to the problem discussed above in reducing the time for mounting and dismounting the rigid drive members in place of idle die cutting or printing members in a die cutting apparatus of the type discussed. The so called bridge of U.S. Pat. No. 6,575,065 discussed above is not related to this problem and is only concerned with filling in the unevenness created by spaced cutting die plates. It contemplates using relatively large relatively stiff sections to serve as a bridge between presently used die plates and is not concerned with replacing idle die cutting or printing rollers. However, the presently used drive members are somewhat similar to the so called bridges and therefore do not suggest the problem with such drive members. The remaining references are even more remote to this problem and do not suggest a solution.

A device according to an embodiment of the present invention is for use on a ferrous die cutter/scoring anvil roll in a die cutting/scoring system including a die cutter/scoring blanket roll for receiving a blank sheet therebetween. The device frictionally conveys the blank sheet between the anvil and blanket rolls in place of die cutting/scoring rules. The device comprises a pliable sheet material substrate arranged for magnetic releasable attachment to and about the die cutting anvil roll for substantially encircling the anvil roll and a pliable relatively high friction compressible engagement member attached to the substrate arranged for negligible damaging engagement with the blank and for frictionally driving the blank between the anvil roll and the die cutter/scoring blanket roll during the engagement.

As a result, the pliable substrate and pliable high friction material on the substrate are relatively limp for ease of installation and are magnetically mounted and dismounted with relative ease from the cylinder from which the die cutter/scoring plate members have been removed. The relatively limp pliability of the substrate and high friction material readily conforms to the shape of the cylinder and wraps about the cylinder in one embodiment a full circle and in one embodiment is in strip form which is relatively small as compared to the current drive members bolted to a cylinder roller. In another embodiment, two such devices are wrapped about the cylinder in spaced pairs along the cylinder in a matter of a few seconds saving considerable downtime of the die cutting apparatus. The devices can be placed arbitrarily anywhere on the die cutting cylinder from which the die cutting rule members have been removed in an idle state of the die cutting cylinder. Also the devices may have any desired widths.

In a further embodiment, the sheet material substrate and engagement member together form a relatively narrow elongated strap and thus are easily handled and wrapped about a cylinder. In one embodiment, the sheet material substrate is one of magnetic rubber, magnetic elastomeric material or magnetic vinyl for magnetic attachment to the steel die cutter/scoring cylinder In another embodiment the engagement member is bonded to the substrate and in one embodiment is formed from molded foam.

In a further embodiment, the engagement member is molded urethane and molded synthetic material formed with a series array of teeth for the engagement.

In a still further alternative embodiment, the engagement member may be a smooth strip of foam rubber or plastic.

In a further embodiment, the engagement member has a series array of spaced apart slits in a flat state and which slits form V shaped grooves when the engagement member is wrapped about the die cutter/scoring cylinder from which die cutter/scoring members have been removed.

IN THE DRAWING

Figure 5:
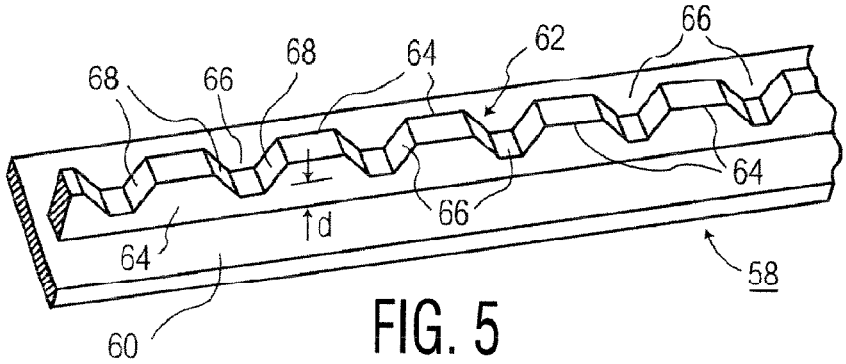
FIG. 5 is a flat state isometric fragmented view of one of the drive members of the embodiment of FIG. 4.
Figure 5A:
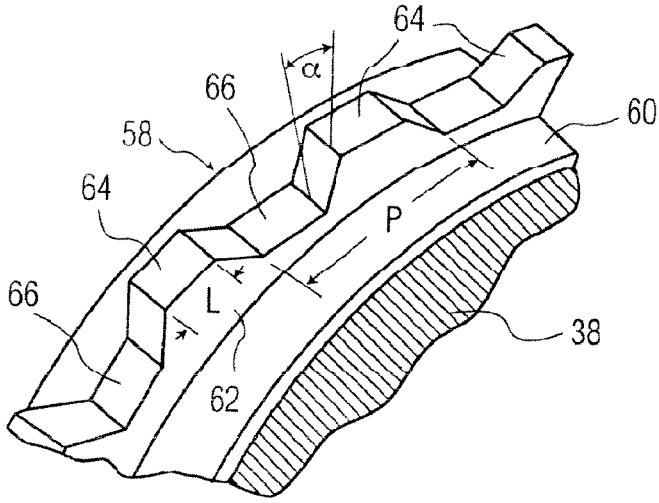

FIG. 5*a* is an isometric fragmented view of a portion of the drive member of FIG. 5 wrapped about the mating portion of a die cutting/scoring cylinder.

Figure 6:
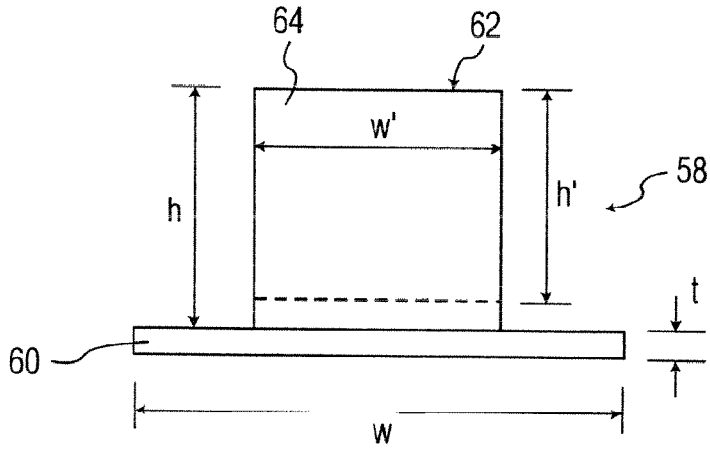
Figure 7A:
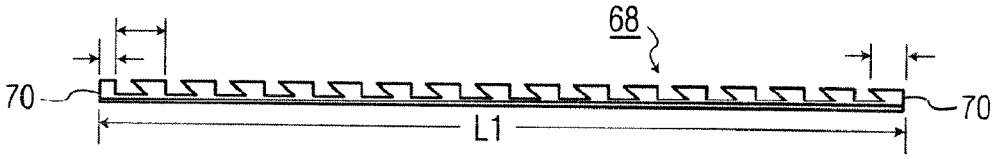
Figure 7B:
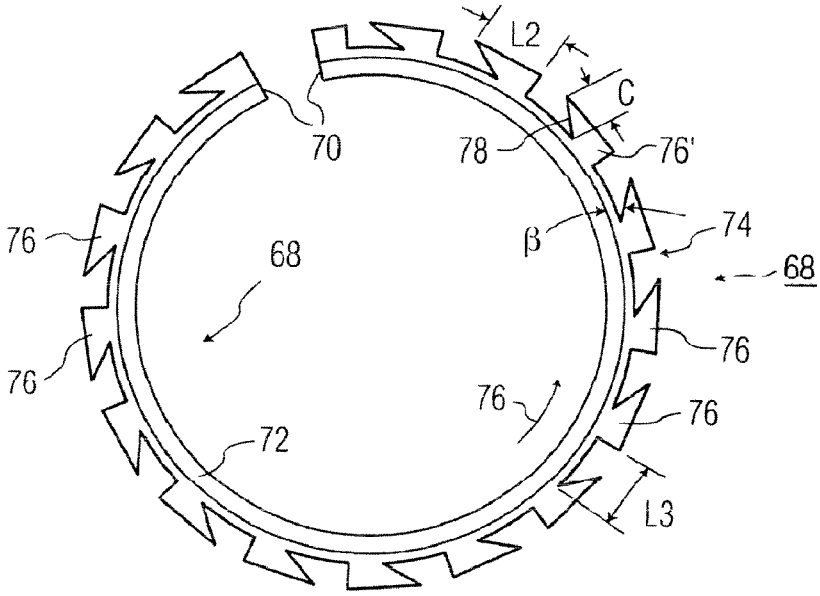
Figure 8A:
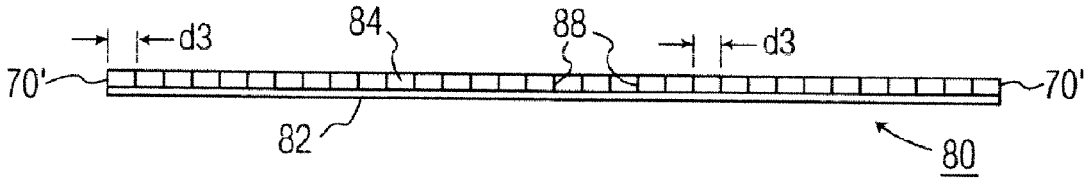
Figure 8B:
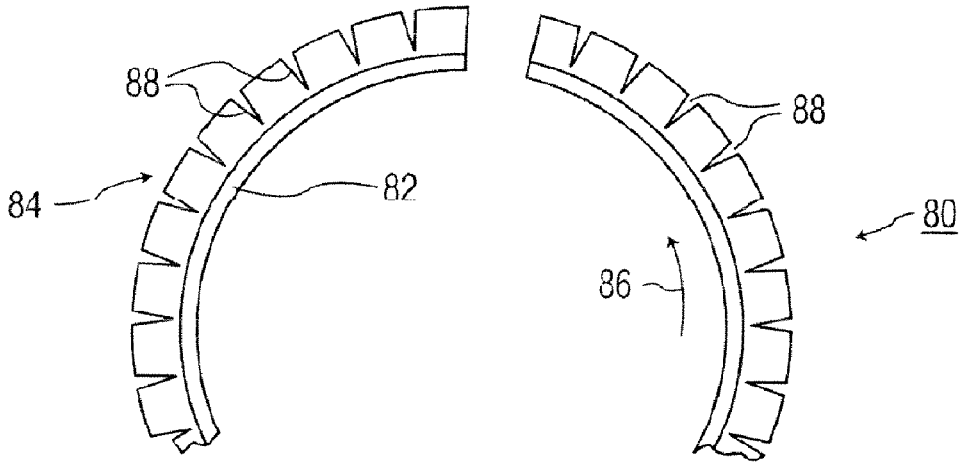
Figure 9A:
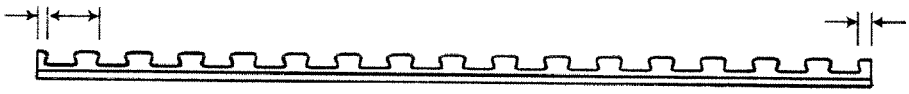
Figure 9B:
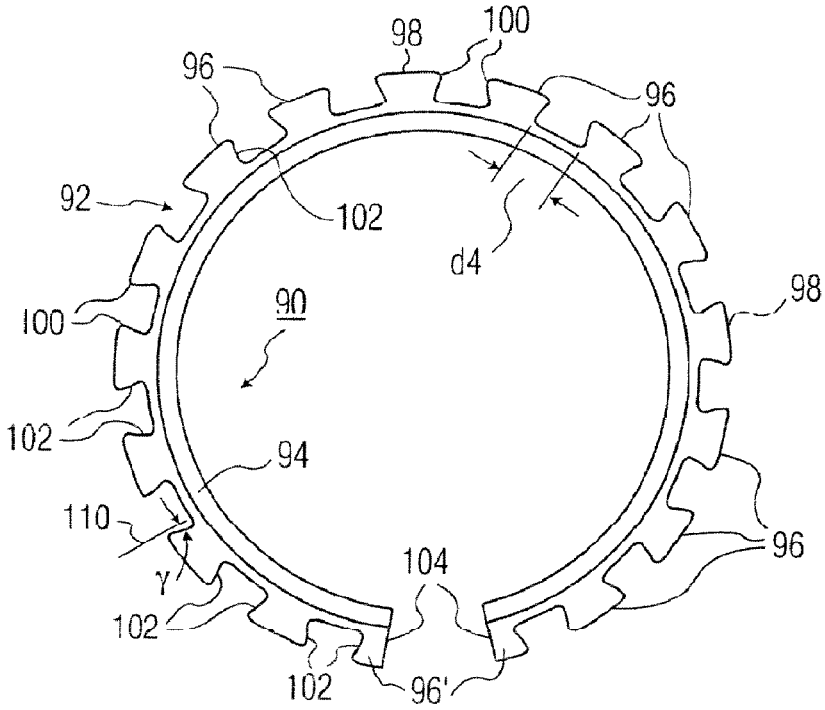
Figure 10A:
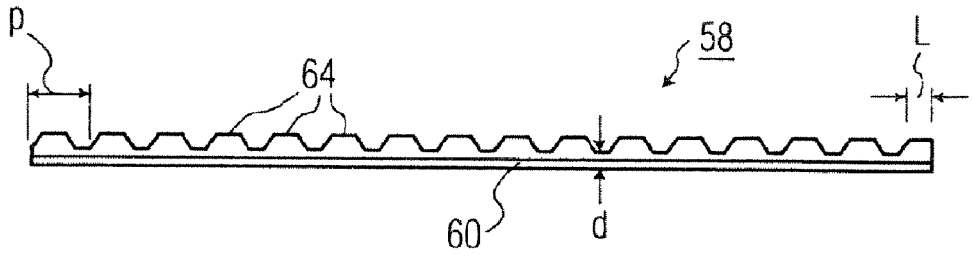
Figure 10B:
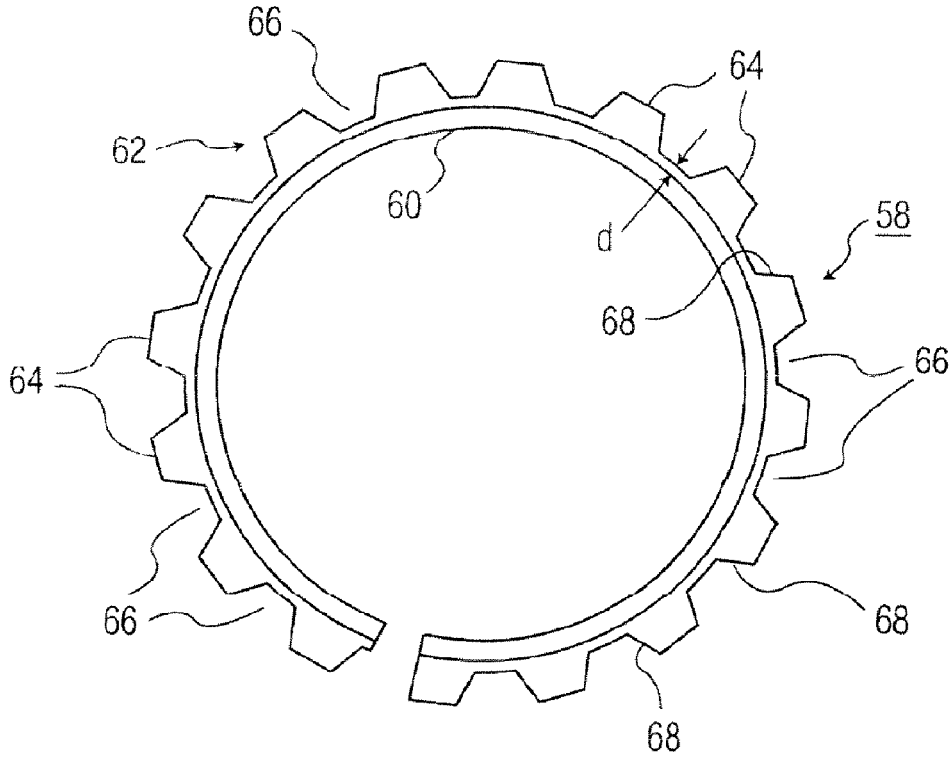
Figure 11A:
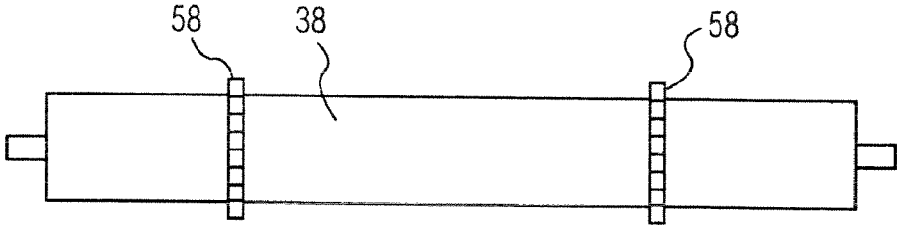
Figure 11B:
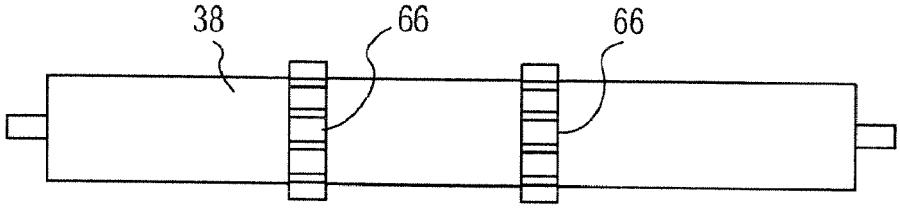
Figure 11C:
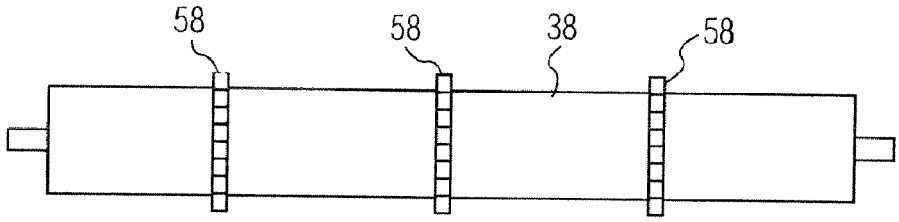
Figure 12:
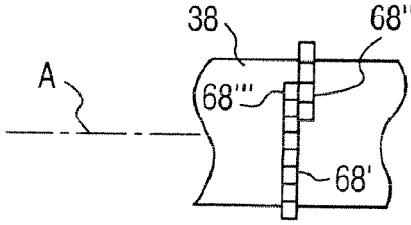

FIG. 6 is an end elevation view of the drive member of FIG. 5;

FIGS. 7*a* and 7*b* are respective side elevation views of a drive member in the flat state and in annular state when wrapped about a die cutter/scoring cylinder;

FIGS. 8*a* and 8*b* are respective side elevation views (and fragmented view in FIG. 8*b*) of a further embodiment of a drive member in the flat state and in annular state when wrapped about a die cutter/scoring cylinder;

FIGS. 9*a* and 9*b* are respective side elevation views of a further embodiment of a drive member in the flat state and in annular state when wrapped about a die cutter/scoring cylinder;

FIGS. 10*a* and 10*b* are respective side elevation views of a further embodiment of a drive member in the flat state and in annular state when wrapped about a die cutter/scoring cylinder;

FIGS. 11*a*, 11*b* and 11*c* are respective side elevation views of a die cutter/scoring cylinder with different embodiments of drive members according to the present invention attached thereto; and FIG. 12 is a fragmented side elevation view of a die cutting/scoring cylinder with a further embodiment of a drive member.

In the drawings, preferred embodiments of the present invention are illustrated wherein like parts are designated with like reference numerals. These drawings are diagrammatic and actual parts may differ from the drawings in scale and shape.

Figure 1:
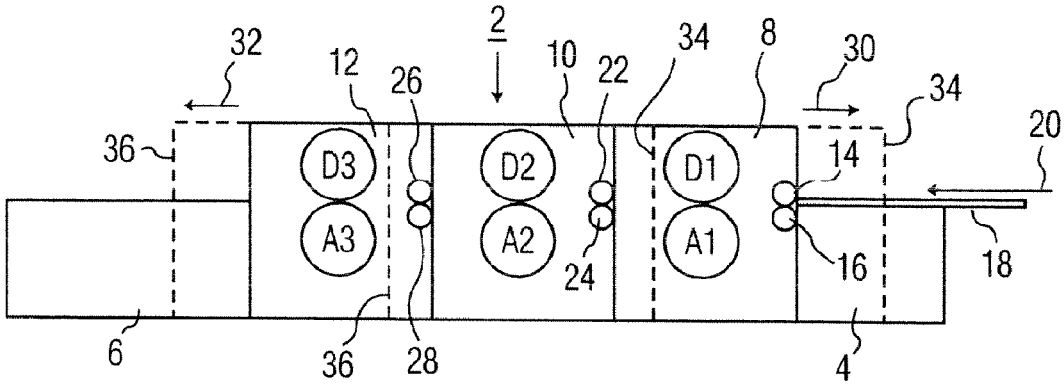
FIG. 1 PRIOR ART
FIG. 1 is a side elevation view of a prior art die cutting/scoring apparatus.

In FIG. 1, conventional prior art die cutting/scoring apparatus 2 is shown diagrammatically and comprises an input section 4 and an output section 6 and three representative die cutting/scoring and printing sections 8, 10 and 12. Each section 8, 10 and 12 has an upper rotatable cylinder D which is either a die cutting/scoring cylinder or a printing cylinder according to a particular implementation of a given job. The term job refers to a production operation wherein a plurality of identical sheets of blank material, such as paper board used to form boxes, is processed to form a plurality of identical products. The products typically may be boxes formed from blank sheet cardboard, other paper board or other sheet material such as plastic and the like. The sheets are cut with through cuts, partial cuts or creases or perforations or any combination thereof according to a given box or product design. It is important that the cut sheet material of each product be accurately cut and that the cuts and printed subject matter if any are in proper registration among each of the cuts and printed matter and among the different sheets being processed. Therefore it is important that the sheets be conveyed through the apparatus consistently from sheet to sheet for the entire job.

Aligned with upper cylinder D1, D2 and D3 of each respective section 8, 10 and 12, is a lower corresponding anvil roll cylinder A1, A2 and A3. The cylinders A1, A2 and A3 are each covered with a urethane blanket as known in this art. The upper cylinder D1, D2 and D3 of each section carries either a series of one or more cutting knives or rules or a printing plate member (not shown) for printing desired indicia on the sheet material. It is important therefore that the conveyed sheet material be conveyed precisely from section to section and from sheet to sheet with respect to each of the cylinders D1, D2 and D3 to insure proper registration of the print media or cuts on each sheet material 18 being processed for a given job, the sheet materials 18 all being identical for that job.

Pinch rollers 14, 16 form a first pair located in and at the entrance to section 8 for pushing sheet material 18 in direction 20 into section 8. The sheet material 18 may have any size and is merely representative of any such material. The cylinders D1 and A1 then receive the pushed sheet material 18 and while performing the desired printing or die cutting/scoring, convey the received sheet material 18 through the section 8 to section 10 into engagement with pinch rollers 22, 24 of the next section 10.

Pinch rollers 22, 24 located at the entrance to section 10 pull the received sheet material 18 from section 8. They then push that material into section 10 between cylinders D2 and A2. These cylinders then grab the sheet material and convey it through the section 10, while performing their respective die cutting/scoring or printing.

The sheet material 18 then exits section 10 and engages a third pair of pinch rollers 26, 28. These rollers are located in and at the entrance to section 12. These rollers pull the sheet material from section 10 and then push the material to and between the cylinders D3 and A3 of section 12. The cylinders D3 and A3 perform die cutting/scoring typically and while so performing convey the sheet material from the section 12. Other rollers (not shown) may be used to further convey the sheet material to output section 6 where the sheet material is further processed (e.g., stacked or packaged or the like).

Each of the sections 8 and 12 of the apparatus 2 are mounted to be displaced in respective directions 30 and 32. Section 8 may be displaced to the position shown in phantom at dashed lines 34. Section 10 may be displaced to the position shown in phantom at dashed lines 36. The sections are displaced manually in a manner not shown as these are conventional commercially available sections.

The sections 8 and 12 are displaced to permit an operator to be able to pass into the space between sections 10 and 12 or between sections 8 and 10. The operator enters these spaces to replace printing members or die cutter/scoring members on the various ones of the cylinders D1, D2 or D3. These cylinders are relatively long, e.g., about 10 feet, and thus access by personnel is required along their lengths between the sections 8 and 10 or 10 and 12 to remove and replace the various die cutting/scoring members, drive members or printing members for different jobs entailing different blank material, different die cut patterns and different printed matter in a manner to be described.

Figure 2:
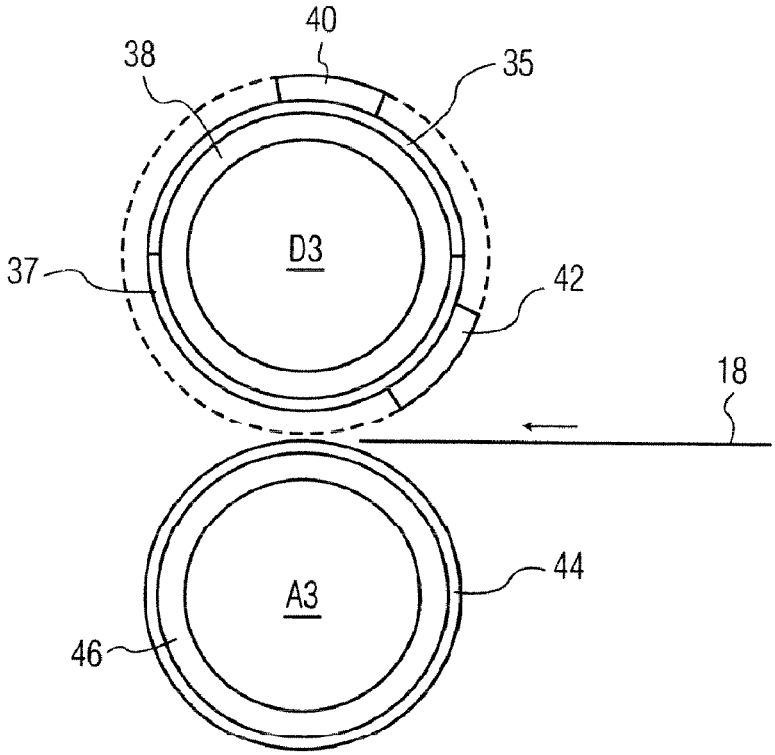
FIG. 2 PRIOR ART
FIG. 2 is a side elevation view of a pair of prior art die cutting/scoring and mating die cutter/scoring blanket cylinders.

In FIG. 2, a representative cylinder D3 and anvil roll cylinder A3 are shown in more detail. The cylinder D3 has two preformed plywood semi circular cylindrical die cutter/scoring members 35 and 37. These members are semicylindrical shells which when assembled together encircle steel roller 38 when attached to the roller 38. The members 35 and 37 have cutting knives 40, 42 or rules as they are known, attached. A urethane sheet material blanket 44 covers the steel roller anvil 46 of cylinder A3. The sheet material 18 is conveyed through the cylinders D3 and A3 by the pressure of the rotating knives on the sheet material is it is being cut.

The members 35 and 37 are formed from plywood sheets about 1.27 cm (½ inch) thick and about 25.4 cm (10 inches) long but may have any length according to a given implementation. A series array of such sheets is attached to the steel roller 38 by bolts. The bolts pass through holes (not shown in FIG. 2) in the members 35 and 37 (See the shell 53, holes 56, of drive member 50, F*ig*.3), which holes are aligned with threaded bores in the roller 38 (bores 48, FIG. 3). The mounting and dismounting of the members is time consuming as discussed above.

Figure 3:
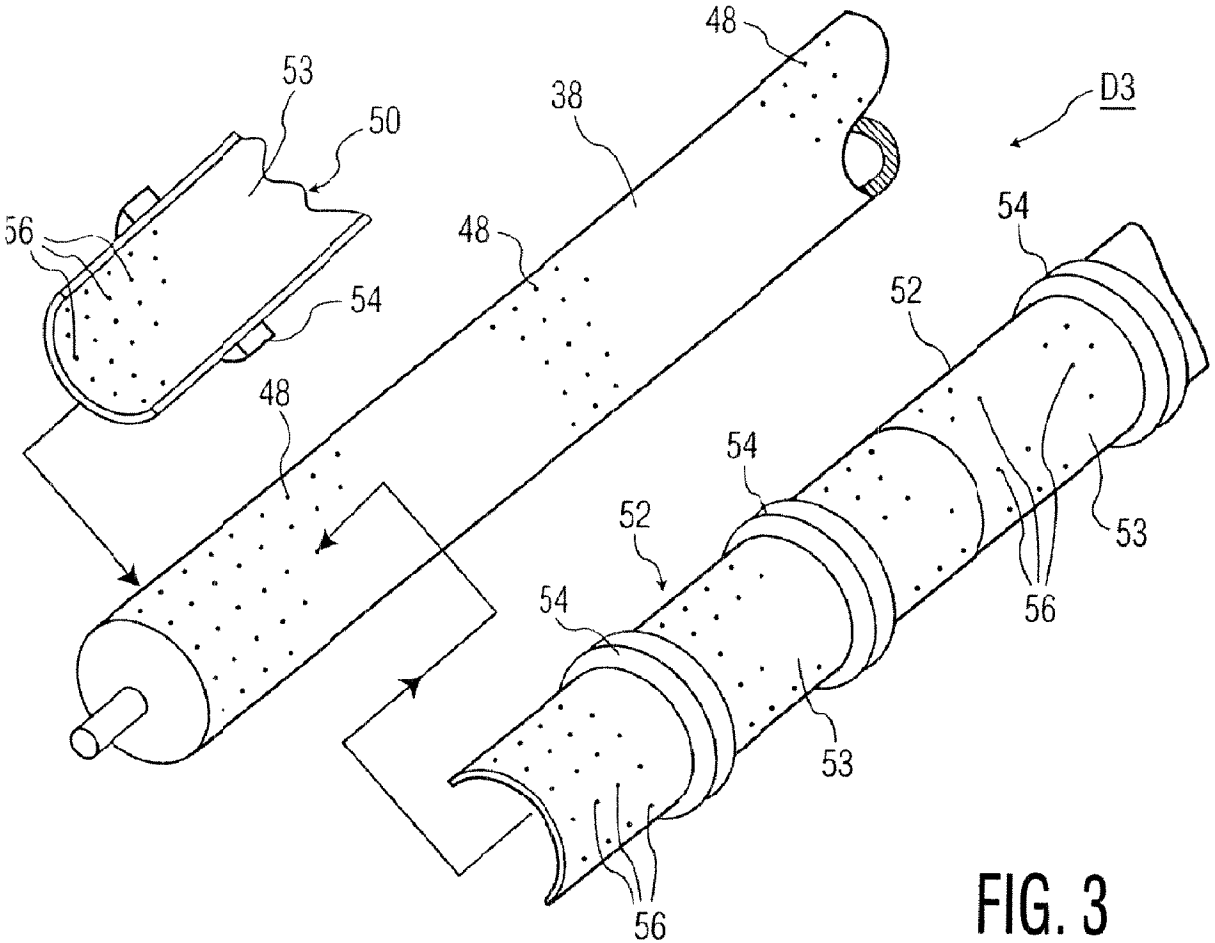
FIG. 3 PRIOR ART
FIG. 3 is an isometric exploded view of a die cutter/scoring cylinder and one prior art drive member of a mating pair of members for driving a sheet member to be die cut through an apparatus section in which no die cutting/scoring or printing occurs.

A problem arises as noted in the introductory portion when at times the die cutter/scoring cylinder D3 and anvil cylinder A3 or the cylinders of the other sections 8 or 10 as the case may be are not used. In this situation, the die cutting/scoring members 35 and 37 need to removed. FIG. 3 illustrates the array of threaded bores 48 in the outer surface of the roller 38 of cylinder D3 (FIG. 2). Drive members 50 and 52 are attached to the roller 38 to replace the cutting members 35, 37, FIG. 2, via bolts attached to the bores 48. The drive members 50 and 52 are used to drive the sheet material 18 between the cylinders D3 and A3, FIG. 2 in place of the die cutting/scoring members.

Drive members 50 and 52 may be identical or may subtend different angles according to different implementations, e.g., 270° and 60° instead of 180° each as shown in FIG. 3 wherein the members 50 and 52 subtend the same 180° angle. The drive members comprise plywood shells 53 the same as used for the die cutting/scoring rules 40, 42 of FIG. 2. Instead of die cutting/scoring rules. however, elastomeric or rubber, foam or other high friction drive strips 54 are bonded to the outer surface of the shells 53 of members 50 and 52. Typically two spaced strips 54 are bonded to each shell 53. The strips 54 of the members 50 and 52 are aligned to form a continuous circular strip when the members 50 and 52 are attached to the roller 38. The shells 53 have an array of through bores 56, e.g., 40 to 50, for receiving screws or bolts. These screws or bolts fasten the members 50 and 52 to the roller 38 via the mating threaded bores 48 in the roller. In use, the compressible friction strips 54 frictionally engage and displace the sheet material 18. The strips do not damage the relatively soft sheet material 18, such as corrugated cardboard or the like, as the roller 38 rotates to convey the sheet material 18 through the section 12 containing the cylinders A3 and D3 (FIG. 1). As noted in the introductory portion, to mount and dismount the prior art drive members 50 and 52 is time consuming and may take as much as 20 minutes to perform these steps. If ten jobs, for example, are being run in a day shift, that means the apparatus 2 is down 200 minutes (not in use), which is wasteful.

Figure 4:
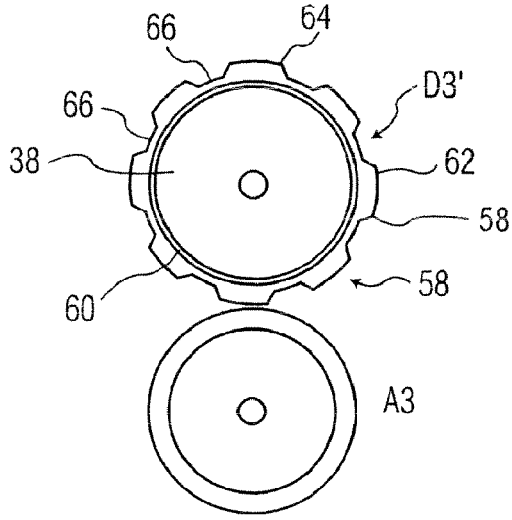
FIG. 4 is a side elevation view of an upper die cutter/scoring cylinder and lower die cutter/scoring blanket covered cylinder with a pair of drive members (only one of which is shown) according to an embodiment of the present invention wrapped about the upper die cutter/scoring cylinder from which the die cutting/scoring plates of FIG. 2 have been dismounted.

In FIG. 4, cylinder D3' comprises roller 38 which is typically formed of steel, which is a ferrous alloy to which magnetic elements attach. A set of identical drive members 58 (only one of which is shown in FIG. 4) according to a preferred embodiment of the present invention are magnetically attached to the roller 38. A typical set in one embodiment comprises two drive members (see FIGS. 11*a* and 11*b*), but there could be more or less such members according to a given implementation (See FIG. 11*c* showing three members). The drive members 58, FIGS. 5, 5*a*, 6, 10*a* and 10*b*, comprise a substrate 60 and an engagement member 62 for engaging the sheet member 18. The substrate 60 is a pliable vinyl, rubber or elastomeric sheet each being magnetic material. Such material is commercially available. The value of the magnetism of the substrate is that which is sufficient to keep the substrate 60 from slipping on the roller to which it is attached in combination with the friction between the substrate and roller. Such a value of magnetism can be determined empirically by one of ordinary skill without undue experimentation with respect to the needed friction load between the substrate and roller to preclude slippage therebetween during use. For example, for a given magnetism value, the contact area of the substrate (it is dimensioned accordingly) to the roller may be set to provide the desired friction load between the substrate and the roller to preclude slippage therebetween in use. For example, for a relatively weak magnetic field created by the substrate, the contact area would be enlarged as compared to a substrate contact area exhibiting a stronger magnetic field.

The substrate 60 is pliable in the sense it is relatively limp and is readily bendable to any shape and easily conforms to the cylindrical circumference of the roller 38 by merely wrapping the member 58 about the cylindrical roller 38 encircling the roller at least 360°. This is in contrast to molded urethane which is stiff and requires significantly more force to bend and thus is significantly more difficult to attach to a cylindrical roller as disclosed for example in U.S. Pat. No. 6,575,065 discussed in the introductory portion.

The substrate 60 in one embodiment is magnetic vinyl having a thickness t of about 3.175 mm (⅛ inch), FIG. 6, and a width w of about 3.8 cm (1.5 inches). The substrate of these dimensions is relatively flexible and is easily bent into any circular configuration. The substrate 60 length in a direction that is normal to the plane of the drawing sheet, FIG. 6, is sufficient to completely encircle the mating steel die cutter/scoring roller 38, FIG. 4. In one embodiment the length is about 81 cm (32 inches) to mate with and wrap about an 81 cm roller circumference. The substrate 60 magnetically attaches to and detaches from the roller 38 in a matter of seconds by merely manually wrapping the relatively small and light substrate 60 about the roller.

One end of the substrate may be attached to the roller first and the rest is then placed against the roller sequentially. In the alternative, the substrate is 60 is flattened and then readily bent about the roller to magnetically attach the substrate to the roller due to the substrate flexibility and relatively small dimensions. Being relatively long and narrow, the substrate is readily attached to the roller. Being relatively small and light, as compared to prior art drive member shells of the type shown in FIG. 3, the substrate is easily handled by one person. Also the substrate may be placed at any arbitrary location along the roller longitudinal axis and occupies a comparatively small amount of surface area of the roller 38.

Sheet material 18 engagement member 62, FIG. 6, is in one embodiment molded foam, rubber or plastic, e.g., molded urethane, or other synthetic material. This material is of relatively high friction, is compressible and is of such material so that it will not damage the sheet material 18 when engaged therewith to drive the sheet material 18. What is required is that the member 62 have negligible damaging effect on the sheet material 18 when driving this sheet material, which typically is paper board or card board and which material 18 is relatively soft in some implementations.

Acceptable damage is determined on a case by case basis depending upon the end use of the material. For example, a box with an exterior fine decorative finish such as used in cosmetics and the like or for retail shelf use of a product for sale should not have any visible damage that would detract from its appearance. On the other hand, a shipping box that is for use for machinery, motors, parts of all sorts or tools and the like for storage in warehouses of distributors without decorative exterior finishing may be acceptable with some slight exterior blemishes. Generally, any blemish is not desirable, but if miniscule in visual appearance, may be acceptable in some circumstances. In any case, drive members are known as discussed in the introductory portion and the problem of precluding damage to the driven sheet material is addressed by such members as well.

The engagement member 62 material is also flexible and is attached to the substrate. Together, the combined substrate and engagement structures are relatively flexible, pliable, limp, lightweight, readily bent and carried by a person and easily wrapped about a roller. The combined engagement member and substrate appear in the form of a relatively elongated narrow width strap for example. The member 62 is formed with a width w', FIG. 6, that is less than the width w of the substrate 60, e.g., 1.83 cm (0.72 inches). The member 62 has a height h above the substrate that is sufficient to grip and convey the material 18 with some compression of the member 62, e.g., 1.8 cm (0.7 inches) when in non-damaging engagement with the sheet material 18. The member has a length in one embodiment the same as that of the substrate 60.

The member 62 is in one embodiment formed with teeth 64, but may be smooth surfaced in a further embodiment. Teeth 64 are in one embodiment trapezoidal with trapezoidal spaces 66 between the teeth. In one exemplary embodiment, the teeth 64 may have a crest length L, FIGS. 5*a* and 10*a*, of about 1.9 cm (0.77 inches) with a tooth wall 68 inclined angle a to $\alpha$ normal to the substrate 60 about 27°. The tooth height h', FIG. 6, may be about 1.27 cm (0.5 inches). The pitch p of the teeth 64, FIGS. 5*a* and 10*a*, may be about 5.2 cm (2.06 inches). The teeth 64 may be spaced above and from the substrate 60 a distance d, FIGS. 5 and 10*a*, of about 0.5 cm (0.20 inches).

In operation, in FIG. 11*a*, in one preferred embodiment, two drive members 58 are manually placed on the roller 38 by wrapping about the roller in spaced relation to each other. It takes only a few seconds to wrap these relatively limp drive members about the roller 38 after the die cutting/scoring rule members 35 and 37, FIG. 2, are unbolted and dismounted from the roller 38. Of course, the section 12 is first displaced in direction 32, FIG. 1, to permit the dismounting to take place. Once the section 12 is displaced, a person enters the space between sections 10 and 12 and dismounts the die cutter/scoring members from the roller 38 of cylinder D3. The person then attaches the drive members to the roller 38. Once the drive members 58 are wrapped about the roller 38, the section 12 is returned to its operating location shown in solid line in FIG. 1.

To mount the die cutter/scoring members 35 and 37, the process is repeated in which the section 12 is displaced and the drive members 58 are quickly removed in a matter of seconds by peeling them off of the roller against the magnetic attraction forces. The die cutter/scoring members are then bolted in place to the roller 38 and the section 12 returned to its operating position of FIG. 1 Any of the cylinders D1, D2 or D3 can receive the drive members 58 if such cylinders are to be idled in the next job.

As shown in FIG. 11*b*, two drive members 66 which are wider than members 58 may be used in place of members 58 on roller 38 according to the parameters of the operation of this roller. In FIG. 11*c*, three drive members 58 are employed. The number of drive members used depends upon the size of the material 18 being processed. Wider material may need more drive members as compared to relatively narrow sheet material. It does not matter how many drive members are used as they are quickly assembled and disassembled from the roller 38. The drive members may also have any desired width according to a given implementation and sheet material being processed.

In FIGS. 7*a* and 7*b*, an alternative embodiment of a drive member 68 according to the present invention is illustrated. The drive member has a length L1 the same as the drive member 58 sufficient to encircle the roller 38 with the ends 70 abutting when wrapped about the roller 38. However, this abutting condition is preferred and optional. This is not critical. See for example the description below regarding FIG. 12. What is required is that the teeth or drive member at the ends 70 are spaced sufficiently close so that the blank being driven by the drive member 68 is driven continuously without interruption.

The drive member 68 comprises a substrate 72 and an engagement member 74. The substrate in one embodiment is as described above for substrate 60 of member 58. The roller 38, not shown in FIGS. 7*a* and 7*b*, in use rotates in direction 76 with the drive member 68 attached. The engagement member 74 is made of the same material as engagement member 62 of FIGS. 4, 5 and 5*a*.

The engagement member 74 has teeth 76 that are different than teeth 64 of member 62. The teeth 74 are all identical so a description of one tooth is representative. Representative tooth 76' has heights h and h' (FIG. 6) the same as tooth 58. The tooth 76' has a cantilevered portion C and an overall length L2. Length L2 may be about 3.4 cm (1.35 inches). The portion C may in this embodiment be about 1.8 cm (0.7 inches) and has an inclined wall 78 that is inclined at an angle $\beta$ of about 36°. The teeth 76 in one embodiment have a root spacing L3 of about 3.3 cm (1.31 inches).

In FIGS. 8*a* and 8*b*, an alternative embodiment of a drive member 80 according to the present invention is illustrated. The drive member 80 has a length the same as the drive members 58 and 68 sufficient to encircle the roller 38 with the ends 70' abutting when wrapped about the roller 38. However, this abutting condition is preferred and optional and is not critical. The drive member 80 comprises a substrate 82 and an engagement member 84 bonded to the substrate. The substrate 82 In one embodiment is magnetic vinyl or magnetic rubber sheet material as described above for the other embodiments. The roller 38, not shown in FIGS. 8*a* and 8*b*, in use rotates in direction 86 with the drive member 80 attached. The engagement member 84 is made of the same material as engagement members 62 and 68.

The engagement member 84 has identical equally spaced optional slits 88 in the fiat state that extend partially into the member 84, e.g., 1.27 cm (0.5 inches) at spaced distances d3 of about 2.54 cm (1 inch). The member 84 has a height h, FIG. 6, of about 1.78 cm (0.7 inches) and a width w' the same as that of member 58, FIG. 6. When the member 84 is bent when wrapped about the anvil roller 38, FIGS. 11*a*, 11*b*, or 11*c*, the material of the member 84 at the slits spreads apart to form V shaped grooves. The portions of the member 84 between the slits 88 serve as teeth for gripping the sheet material 18 being conveyed through a section 8, 10 or 12 where employed.

In FIGS. 9*a* and 9*b*, a still further embodiment of a drive member 90 according to the present invention is shown. In this embodiment, the drive member has an engagement member 92 and a substrate 94 to which the member 92 is bonded, and which substrate is identical to the substrates described above. The engagement member is made of the same material as the engagement members previously described. The engagement member 92 has an array of identical teeth 96 which are equally spaced from each other.

Each tooth 96 has a flat crest 98 terminating at a radius at opposite edges 100. The teeth 96 each have mirror image side walls 102 except for the last teeth 96' of the array at opposite ends of the member 90. Teeth 96' may be one half of a tooth 96 and terminate at a planar side wall 104 that lies on a radial plane passing through the center of the roller 38 when attached thereto. The side walls 104 in one embodiment abut when the driving member 90 is mounted on a roller 38. The side walls 102 are inclined at an angle γ (about 13° ) relative to a line 110 normal to the substrate 94. The crest of the teeth 96 have a dimension L (see FIG. 5*a* for a comparable dimension L) of about 2 cm (0.8 inches). The root between teeth 96 has a dimension d4, FIG. 9*b*, of about 2.4 cm (0.95 inches). The height dimensions h and h' are the same as in the other teeth described in connection with FIG. 6. The teeth 96 in one embodiment are on 5 cm (2 inch) centers (This dimension is the pitch, such as pitch p, FIG. 5*a*.) or a total of 15 teeth In a further example, in FIG. 12, the drive member 68' may be longer than the roller 38 circumference. In this case, the drive member is attached in spiral fashion to the roller. In this arrangement, circumferential end portions 68" and 68'" of the drive member 68' may overlie each other in directions along the roller 38 longitudinal axis A.

All of the drive members are easily wrapped about a die cutting/scoring roller 38 for quick mount and dismount, providing considerable increase in productivity of the die cutting/scoring apparatus 2, FIG. 1.

It will occur to one of ordinary skill in this art that various modifications may be made to the disclosed preferred embodiments without departing from the spirit and scope of the invention. The disclosed embodiments are provided for illustration and not limitation. It is intended that the invention is defined by the appended claims.

What is claimed is:

1. A device for use on a ferrous die cutter/scoring anvil roller in a die cutting/scoring system including a die cutter/scoring blanket roller for receiving a blank sheet there between, the device for frictionally conveying the blank sheet between the anvil and blanket rollers, the device comprising:

a pliable magnetic sheet material substrate for magnetic releasable attachment to and about the die cutter/scoring anvil roller for substantially surrounding the anvil roller; and a pliable compressible engagement member attached to the substrate, the pliable compressible engagement member comprising a plurality of compressible teeth arranged for engagement with said blank sheet and for frictionally driving said blank sheet between said anvil roller and the die cutter/scoring blanket roller during said engagement.

2. The device of claim 1 wherein the sheet material substrate and the pliable compressible engagement member together form a relatively narrow elongated strap.

3. The device of claim 1 wherein the sheet material substrate is one of magnetic rubber, magnetic elastomeric material or magnetic vinyl.

4. The device of claim 1 wherein the pliable compressible engagement member is bonded to the substrate.

5. The device of claim 1 wherein the pliable compressible engagement member is molded foam.

6. The device of claim 1 wherein the pliable compressible engagement member is molded urethane.

7. The device of claim 1 wherein the pliable compressible engagement member is molded synthetic material.

8. The device of claim 1 wherein the pliable compressible engagement member is a strip of foam rubber or foam plastic.

9. The device of claim 1 wherein the teeth are identical.

10. The device of claim 1 wherein the teeth are symmetrical relative to each other.

11. The device of claim 1 wherein the pliable magnetic sheet material substrate and the pliable compressible engagement member are bendable for arrangement in a range of positions including a substantially flat state and a substantially annular state.

12. A device for use on a ferrous die cutter/scoring anvil roller in a die cutting/scoring system including a die cutter/scoring blanket roller for receiving a blank sheet there between, the device for frictionally conveying the blank sheet between the anvil and blanket rollers, the device comprising:

a pliable magnetic sheet material substrate for magnetic releasable attachment to and about the die cutter/scoring anvil roller for substantially surrounding the anvil roller; and a pliable compressible engagement member attached to the substrate arranged for engagement with said blank sheet and for frictionally driving said blank sheet between said anvil roller and the die cutter/scoring blanket roller during said engagement wherein the engagement member comprises a strip having a plurality of teeth extending therefrom, wherein the teeth are trapezoidal in cross section and spaced apart by a trapezoidal space.

13. A device for use on a ferrous die cutter/scoring anvil roller in a die cutting/scoring system including a die cutter/scoring blanket roller for receiving a blank sheet there between, the device for frictionally conveying the blank sheet between the anvil and blanket rollers, the device comprising:

a pliable magnetic sheet material substrate for magnetic releasable attachment to and about the die cutter/scoring anvil roller for substantially surrounding the anvil roller; and a pliable compressible engagement member attached to the substrate arranged for engagement with said blank sheet and for frictionally driving said blank sheet between said anvil roller and the die cutter/scoring blanket roller during said engagement, wherein the engagement member has a series array of spaced apart slits in a flat state.

14. A device for use on a ferrous die cutter/scoring anvil roller in a die cutting/scoring system including a die cutter/scoring blanket roller for receiving a blank sheet there between, the device for frictionally conveying the blank sheet between the anvil and blanket rollers, the device comprising:

a pliable magnetic sheet material substrate for magnetic releasable attachment to and about the die cutter/scoring anvil roller for substantially surrounding the anvil roller; and a pliable compressible engagement member attached to the substrate arranged for engagement with said blank sheet and for frictionally driving said blank sheet between said anvil roller and the die cutter/scoring blanket roller during said engagement wherein the engagement member has a series array of spaced apart slits in a flat state and said slits form V shaped grooves when the engagement member is wrapped about the die cutter/scoring anvil roller.

15. A strap for use on a ferrous die cutter/scoring anvil roller in a die cutting/scoring system including a die cutter/scoring blanket roller for receiving a blank sheet therebetween, the strap for frictionally conveying the blank sheet between the anvil and blanket rollers, the strap comprising:

an elongated pliable sheet material strip, wherein the sheet material strip is relatively narrow with respect to the anvil roller, arranged for magnetic releasable attachment to and about the die cutting/scoring anvil roller for substantially surrounding the anvil roller; and a pliable compressible engagement member, wherein the engagement member is relatively narrow with respect to the anvil roller, comprising a plurality of compressible teeth attached to the strip arranged for engagement with said blank sheet and for frictionally driving said blank sheet between said anvil roller and the die cutter/scoring blanket roller during said engagement.

16. A device for use on a ferrous die cutter/scoring anvil roller in a die cutting/scoring system including a die cutter/scoring blanket roller for receiving a blank sheet therebetween, the device for frictionally conveying the blank sheet between the anvil and blanket rollers, the device comprising:

a pliable sheet material member arranged for magnetic releasable attachment to and about the die cutting/scoring anvil roller for substantially surrounding the anvil roller; and a series of pliable compressible engagement members attached to the pliable sheet material member arranged for engagement with said blank sheet and arranged for frictionally driving said blank sheet between said anvil roller and the die cutter/scoring blanket roller during said engagement.

17. The device of claim 16 wherein the series of pliable compressible engagement members are arranged in an array of spaced blank sheet engaging teeth for circumferentially extending about the anvil roller.

18. The device of claim 17 wherein the teeth are any one of rubber or plastic.

19. A device for use on a ferrous die cutter/scoring anvil roller in a die cutting/scoring system including a die cutter/scoring blanket roller for receiving a blank sheet therebetween, the device for frictionally conveying the blank sheet between the anvil and blanket rollers, the device comprising:

a pliable sheet material member arranged for magnetic releasable attachment to and about the die cutting/scoring anvil roller for substantially surrounding the anvil roller; and a series of blank sheet engagement members attached to the member arranged for engagement with said blank sheet and arranged for frictionally driving said blank sheet between said anvil roller and the die cutter/scoring blanket roller during said engagement wherein engagement members are arranged in an array of spaced blank sheet engaging teeth for circumferentially extending about the anvil roller and further including a pliable substrate to which the teeth are attached, the substrate being attached to the pliable sheet material member.

20. The device of claim 19 wherein the teeth are formed of a compressible material which compresses in response to an applied force created by their engagement with the blank sheet.

* * * * *